US006076916A

United States Patent [19]

Kaneko

[11] Patent Number: 6,076,916

[45] Date of Patent: Jun. 20, 2000

[54] PRINTING APPARATUS AND DRIVING METHOD THEREFOR

[75] Inventor: Yuichi Kaneko, Fukushima, Japan

[73] Assignee: Canon Kabushiki Kaisha, Tokyo, Japan

[21] Appl. No.: 08/979,321

[22] Filed: Nov. 26, 1997

Related U.S. Application Data

[63] Continuation of application No. 08/600,126, Feb. 12, 1996, abandoned.

[30] Foreign Application Priority Data

Feb. 14, 1995 [JP] Japan ..... 7-024995

[51] Int. Cl.[7] ..... B41J 23/00

[52] U.S. Cl. ..... 347/37; 347/17

[58] Field of Search ..... 347/37, 17, 18

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,608,577 | 8/1986 | Hori . | |
| 4,723,129 | 2/1988 | Endo et al. . | |
| 4,740,796 | 4/1988 | Endo et al. . | |
| 4,791,435 | 12/1988 | Smith et al. | 347/17 |
| 5,331,340 | 7/1994 | Sukigara | 347/17 X |
| 5,367,325 | 11/1994 | Yano et al. | 347/17 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |
| 4-074191 | 11/1992 | Japan . |

*Primary Examiner*—N. Le
*Assistant Examiner*—Shih-Wen Hsieh
*Attorney, Agent, or Firm*—Fitzpatrick, Cella, Harper & Scinto

[57] ABSTRACT

A printing apparatus and method therefor reduces power-source capacity of the apparatus imposing any load on the printing apparatus and varying its printing speed. In parallel to printing operation, the number of print dots is counted by using a counter, and information amount for calculating the scanning period for each scanning is measured by also using a counter. Then, at the completion of each scanning, a print-duty ratio is calculated from the number of print dots and the information amount for calculating the scanning period for each scanning, and a waiting period to delay starting of the next scanning is set, based on the calculated duty ratio.

25 Claims, 4 Drawing Sheets

PRINTING APPARATUS AND DRIVING METHOD THEREFOR

This application is a continuation of application Ser. No. 08/600,126 filed Feb. 12, 1996, now abandoned.

BACKGROUND OF THE INVENTION

This invention relates to a printing apparatus and, more particularly to a printing apparatus which reduces the power source capacity of the printing apparatus without imposing additional load on the apparatus and varying a printing speed at every scanning, and a driving method therefor.

Conventionally, a printing apparatus, in which a power-source load varies drastically due to a printhead driving load, employs a power source of higher power in consideration of its maximum load. Otherwise, as disclosed in Japanese Patent Publication No. 4-74191, to limit power source output to a lower value than its maximum output, a maximum simultaneous driving load is calculated in advance, and a printing speed is varied in accordance with the obtained maximum simultaneous driving load. This reduces the power-source output upon reception of the maximum load within the power-source output range.

However, in the former case, since the apparatus uses a power source corresponding to the maximum load, the manufacturing cost of such power source and the size of apparatus increase as the maximum load becomes higher. This is inconvenient in the designing, manufacturing and cost effectiveness of the apparatus. In the latter case, the apparatus can use a smaller power source than that of the former case, however, a maximum simultaneous driving load must be obtained for each print-scanning, and the printing speed must be varied at every print-scanning, in accordance with necessity. This requires extremely complex control.

SUMMARY OF THE INVENTION

Accordingly, an object of the present invention is to provide a more compact printing apparatus and driving method therefor which reduces the power source capacity of the printing apparatus without imposing additional load on the apparatus and varying a printing speed at every scanning.

According to the present invention, the foregoing object is attained by providing a printing apparatus which outputs print dots corresponding to print data on a printing medium by scanning a print head in a predetermined direction, comprising: scan means for scanning the print head in the predetermined direction; print means for outputting the print dots on the printing medium, by a predetermined print width, in correspondence with scanning of the print head by the scan means; and delay means for delaying the start of scanning of the print head by the scan means for next printing, based on information for calculating the number of print dots and scanning period for one scanning of the print head by the print means.

Further, the foregoing object is attained by providing a printing method for outputting print dots corresponding to print data on a printing medium by scanning a print head in a predetermined direction, comprising: a print step of scanning the print head in the predetermined direction and outputting the print dots on the printing medium, by a predetermined print width; and a delay step of delaying the start of scanning of the print head at the print step for next printing, based on information for calculating the number of print dots and scanning period for one scanning of the print head.

In accordance with the present invention as described above, printing based on print data is performed on a printing medium, by a predetermined printing width, by each one-scanning operation of a print head in a predetermined direction; and in parallel to the printing operation, the number of printing dots and the scanning period are measured at each scanning, and after completion of each print-scanning, starting of the next print-scanning is delayed in accordance with the number of printing dots and measured scanning period.

The present invention is particularly advantageous since it can provide a more compact printing apparatus and driving method therefor, which reduces the capacity of the power source of the printing apparatus without imposing any load on the printing apparatus and varying its printing speed at every scanning.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

<Outline of Printing Apparatus>

Figure 1:
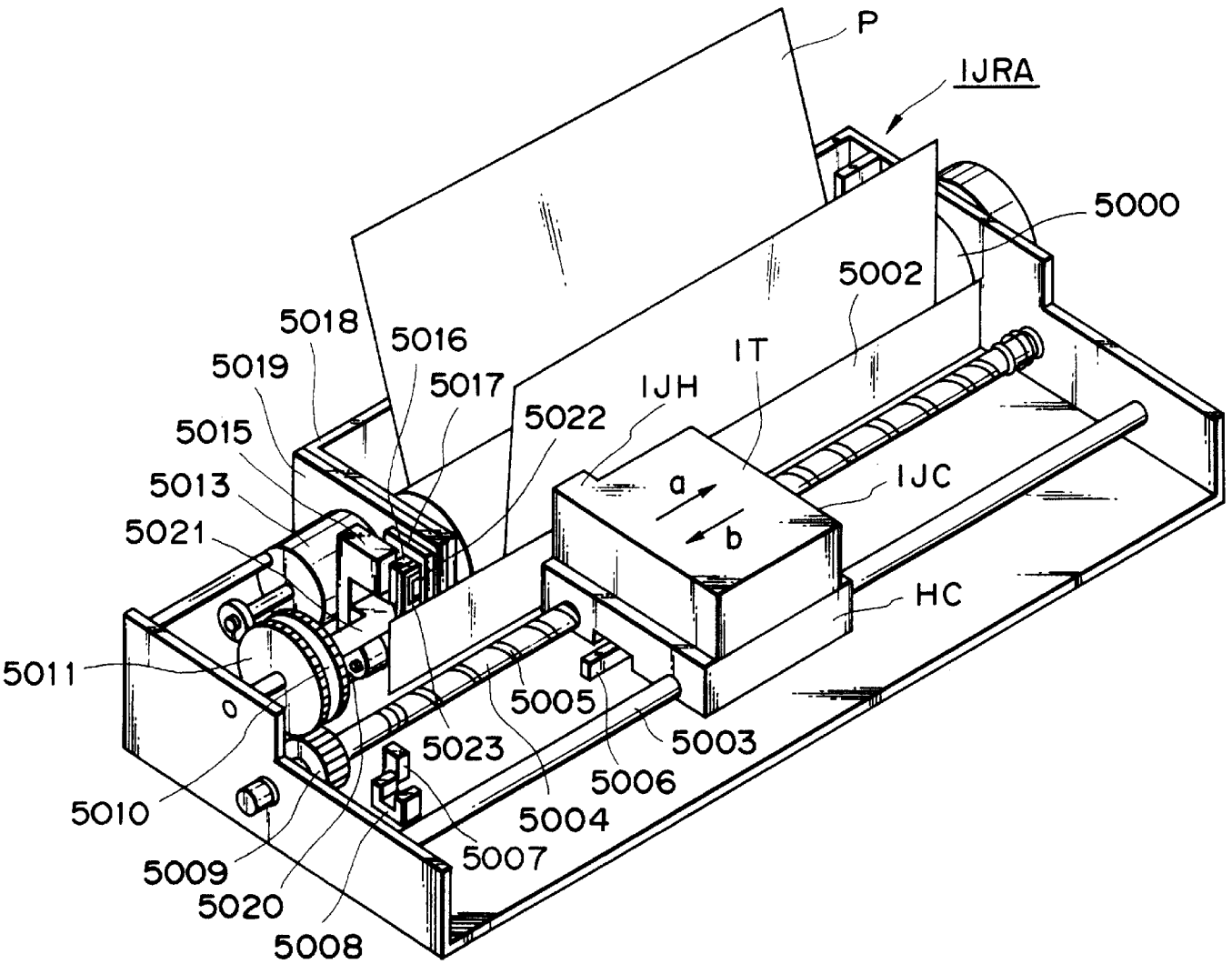
FIG. 1 is a perspective view showing the structure of an ink-jet printer IJRA as a typical embodiment of the present invention.

FIG. 1 is a perspective view showing the structure of an ink-jet printer IJRA as a typical embodiment of the present invention. In FIG. 1, a carriage HC is engaged with a spiral groove 5000 of a lead screw 5004 which rotates via drive force transmission gears 5009 to 5011 interlocking with forward/reverse rotation of a drive motor 5013. The carriage HC has a pin (not shown) and it is reciprocally moved in directions represented by arrows a and b, held by a guide rail 5003. The carriage HC has an ink-jet cartridge IJC which integrally comprises a print head IJH and an ink tank IT. A paper holding plate 5002 presses a print sheet P against a platen 5000 along the moving direction of the carriage HC. Photocouplers 5007 and 5008 are home position detecting members for confirming the existence of lever 5006 of the carriage in this area and changing over the rotational direction of motor 5013. The rotation of the motor 5013 upon transferring the print sheet P is transmitted to the platen 5000 via the transmission gear 5010. The rotation of the platen 5010 transfers the print sheet P in a direction substantially orthogonal to the moving direction of the carriage HC. A support member 5016 supports a cap member 5022 for capping the front surface of the print head IJH. A suction member 5015 performs suction-restoration of the print head through the inside of the cap member 5022 via a cap inner opening 5023. Member 5019 allows a cleaning blade 5017 to move in a back-and-forth direction. A main body support plate 5018 supports the member 5019 and the cleaning blade 5017. It is apparent that any well-known cleaning blade is applicable to the printer of the embodiments. Numeral 5021 denotes a lever for starting the suction operation of the suction-restoration. The lever 5021 moves along the movement of a cam 5020 engaged with the carriage HC. A well-known transmission mechanism such as change-over of a clutch controls a drive force from the drive motor.

When the carriage HC is at the home position area, a desired one of these capping, cleaning and suction-restoration processing is executed at its corresponding position by the lead screw 5004. The timing of any of these processings is not limited to the printer of the embodiments, if a desired processing is performed at a well-known timing.

<Construction of Controller>

Next, the construction of a controller for executing print-control of the above printing apparatus will be described.

Figure 2:
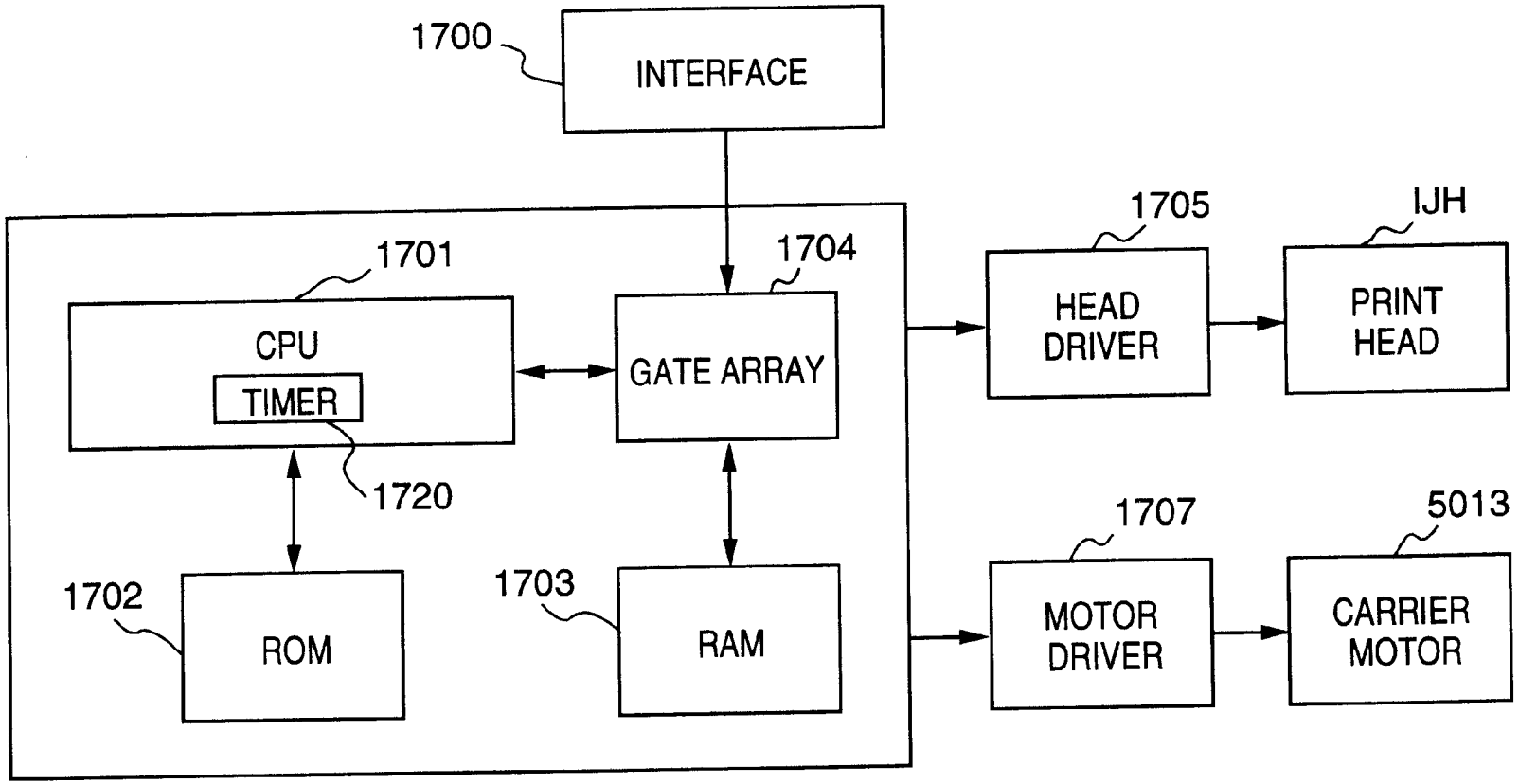
FIG. 2 is a block diagram showing the construction of a controller of the ink-jet printer IJRA.

FIG. 2 is a block diagram showing the construction of a control circuit of the ink-jet printer IJRA. Referring to FIG. 2 showing the control circuit, reference numeral 1700 denotes an interface for inputting a print signal; 1701, a CPU; 1702, a program ROM for storing control programs executed by the CPU 1701; and 1703, a dynamic RAM (DRAM) for storing various data (the print signal, print data supplied to the print head and the like). Reference numeral 1704 denotes a gate array for performing supply control of print data to the print head IJH. The gate array 1704 also performs data-transfer control among the interface 1700, the CPU 1701, and the RAM 1703. Reference numeral 5013 denotes a carrier motor for transferring the print head IJH; 1705, a head driver for driving the print head IJH; and 1707, a motor driver for driving the carrier motor 5013.

The operation of the above control arrangement will be described below. When a print signal is input into the interface 1700, the print signal is converted into print data for a printing operation between the gate array 1704 and the CPU 1701. The motor driver 1707 is driven, and the print head IJH is driven in accordance with the print data supplied to the head driver 1705, thus performing the printing operation.

Figure 3:
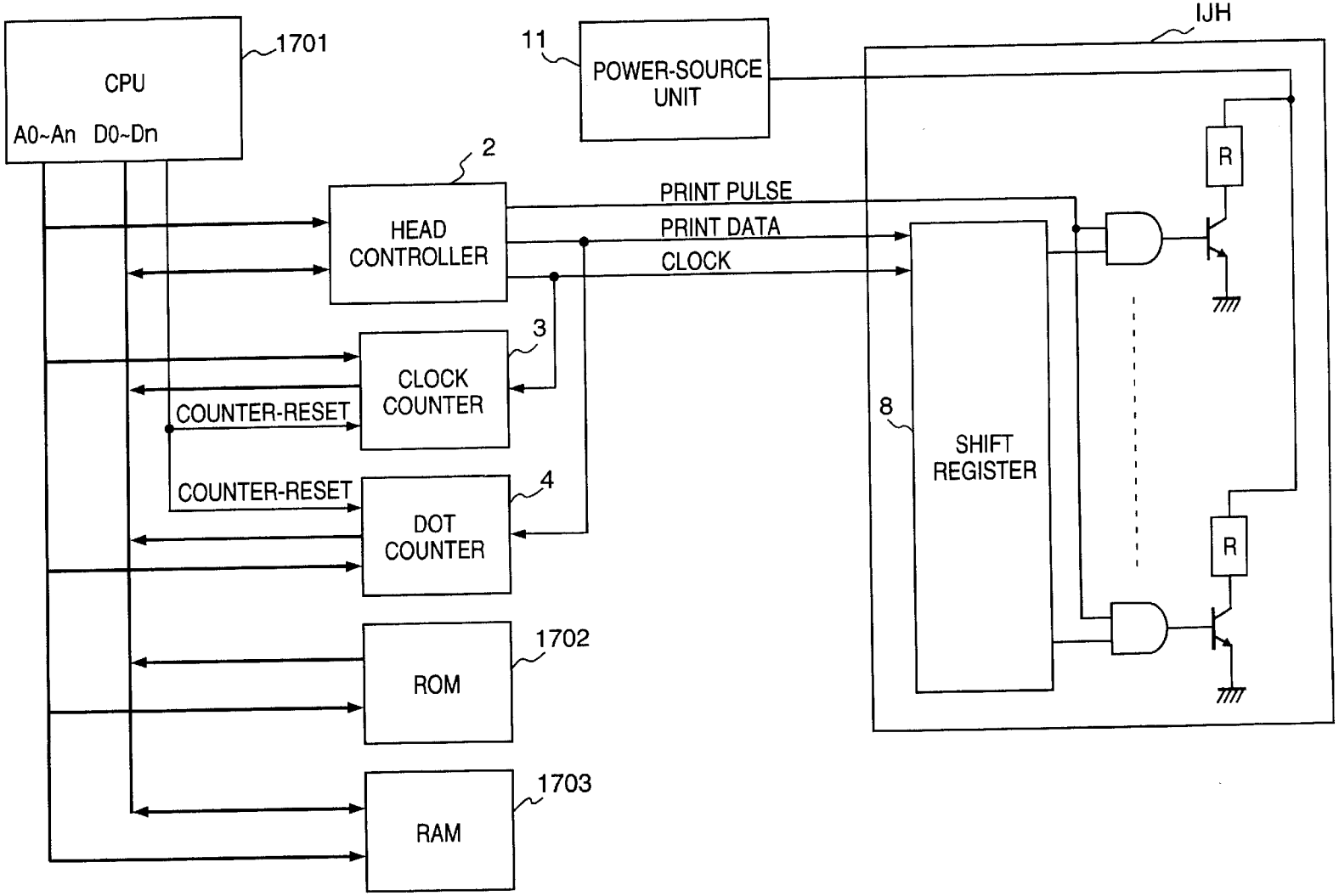
FIG. 3 is a block diagram showing print-control of a print head by the controller in FIG. 2.

FIG. 3 is a block diagram showing print-control part of the print head IJH in the control circuit in FIG. 2.

In FIG. 3, numeral 2 denotes a head controller which controls transfer of print data and print pulse to the print head IJH; and 3, a clock counter which counts print-data transfer clocks used for calculating a scanning period of the print head IJH (hereinafter referred to as "printing time").

For example, the printing time is calculated as follows. The number of columns of print data recorded by a print-scanning of the printhead IJH is obtained from the count value of the clock counter 3 and the number of nozzles of the print head IJH. The time necessary for printing for one-column print data is predetermined. The number of columns is multiplied by the predetermined time for one-column printing, thus the printing time is obtained.

Numeral 4 denotes a dot counter which counts print dots for calculating the load imposed on the power source when the print head IJH is scan-driven; 8, a shift register which converts a serial data array transferred from the head controller 2 into parallel data arrays; and 11, a power-source unit which supplies electricity to the apparatus.

Figure 4:
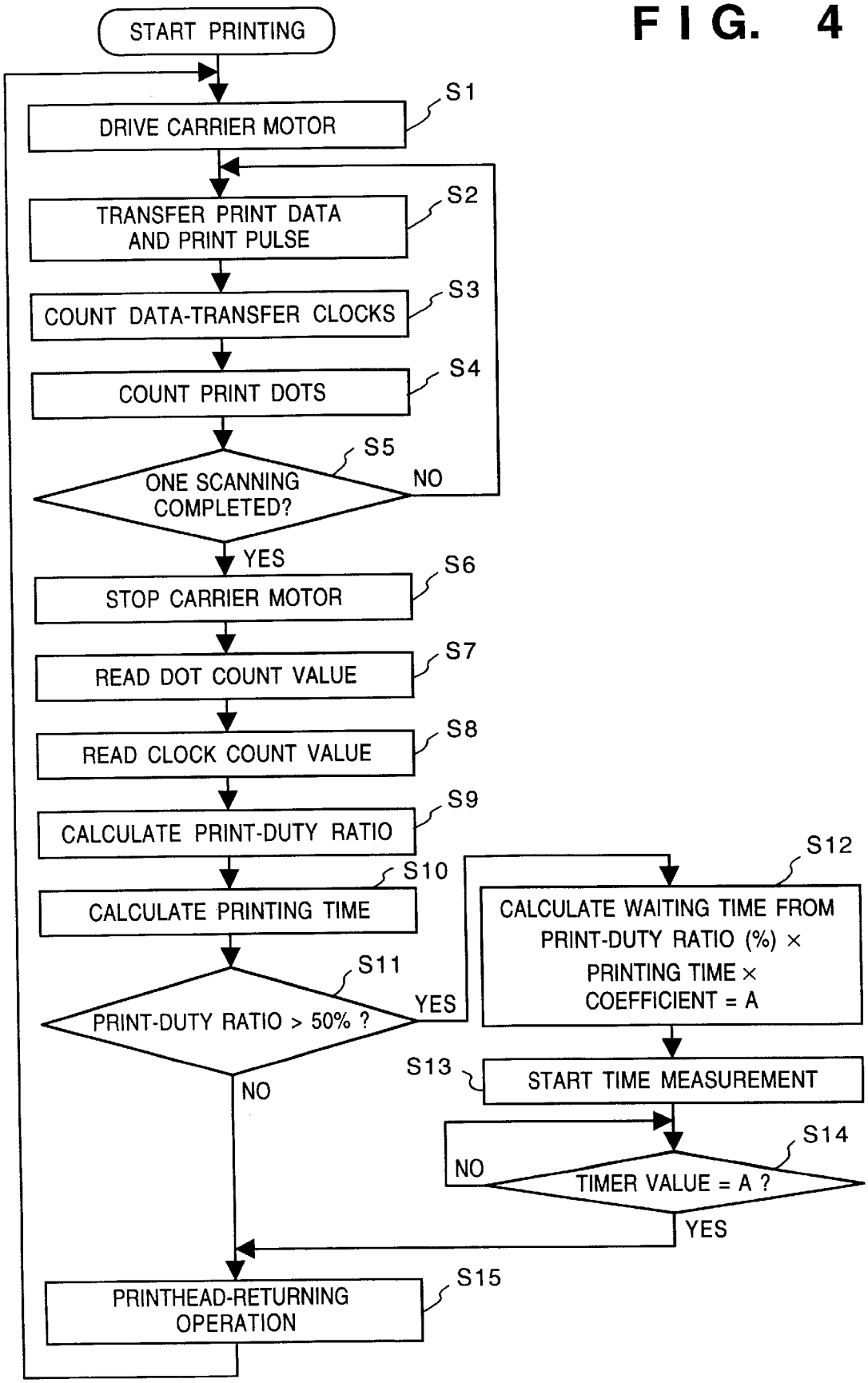
FIG. 4 is a flowchart showing print-control of the printing apparatus of the embodiment.

FIG. 4 is a flowchart showing the print-control of the printing apparatus of the embodiment.

The operation of the apparatus will be described with reference to FIGS. 3 and 4.

Note that in this construction, a rated power of the power-source unit 11 is set such that when a print-duty ratio is less than 50%, the load on the power-source unit is equal to the rated output value or lower, while when the print-duty ratio is 50% or greater, the load exceeds the rated output value. In addition, it is assumed that if printing with 100% print-duty ratio is performed for one line, heat generated by devices constructing the power-source unit does not exceed a rated temperature.

The print-duty ratio is a ratio of the number of pixels (number of print pixels) actually printed by ink-discharge of the print head IJH, with respect to number of possible pixels (number of all possible print pixels) for a print band of a predetermined width, printed by one scanning of the print head IJH. For example, when the print-duty ratio is 50%, the number of print pixels is half of all the possible print pixels.

The CPU 1701 maps print data on the RAM 1703, in accordance with a printing instruction. When print data for one scanning is prepared, the CPU 1701 starts printing operation by driving the carrier motor 5013 at step S1. At step S2, the print data and print pulse are transferred via the head controller 2. At step S3, the clock counter 3 counts data-transfer clocks transferred to the print head IJH, and at step S4, the dot counter 4 counts print dots (number of black data).

At step S5, whether printing for one scanning has been completed or not is determined. If NO, the operation via steps S2 to S4 is repeated by the completion of the printing. When the printing for one scanning of the print head IJH has been completed, the CPU 1701 stops the rotation of the carrier motor 5013 t step S6, then at step S7, reads the count value of he dot counter 4, and at step S8, reads the count value of the clock counter 3.

At step S9, the print-duty ratio of the print width scanned by the print head IJH is calculated, and at step S10, printing time is calculated. At step S11, whether or not the calculated print-duty ratio is 50% or greater is determined.

If NO at step S11, i.e., it is determined that the print-duty ratio is less than 50%, printhead-returning operation is made without waiting operation and the next print-scanning is started at step S5. On the other hand, if YES at step S11, i.e., it is determined that the print-duty ratio is 50% or greater, the CPU 1701 makes the following calculation at step S12: Print-duty ratio×printing time×coefficient (a predetermined coefficient for setting average driving load, imposed upon the power source when the print head IJH is scan-driven, to the rated power or less). At step S13, the calculated value is used to set an internal timer 1702 of the CPU 1701 as waiting time. At step S14, the waiting operation is made until the waiting time has elapsed. Then, at step S15, the printhead-returning operation is made and the next print-scanning is started.

According to the present embodiment, the printing apparatus uses a power source of a rated power allowing printing with 100% print-duty ratio for at least one scanning. In addition, at each scanning, the load necessary for the print-scanning is calculated, and waiting time for the next print-scanning is set in accordance with the calculated load. This reduces the average driving load, imposed on the power-source unit upon driving of the print head, to a rated power of the power source or lower. This reduces power-source requirement of the printing apparatus without varying printing speed for one scanning and pre-reading print-duty ratio for each one scanning of the print head.

Note that the present embodiment has been described using an example where waiting is made when the print-duty ratio is 50% or greater. However, this does not pose any limitation to the present invention; e.g., another percentage may be set.

The embodiment described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the print head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the print head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Laid-Open Patent Application No. 59-123670 which discloses the arrangement using a slot common to a plurality of electrothermal transducers as a discharge portion of the electrothermal transducers, or Japanese Laid-Open Patent Application No. 59-138461 which discloses the arrangement having an opening for absorbing a pressure wave of heat energy in correspondence with a discharge portion.

Furthermore, as a full line type print head having a length corresponding to the width of a maximum printing medium which can be printed by the printer, either the arrangement which satisfies the full-line length by combining a plurality of print heads as disclosed in the above specification or the arrangement as a single print head obtained by forming print heads integrally can be used.

In addition, an exchangeable chip type print head which can be electrically connected to the apparatus main unit and can receive an ink from the apparatus main unit upon being mounted on the apparatus main unit or a cartridge type print head in which an ink tank is integrally arranged on the print head itself can be applicable to the present invention.

It is preferable to add recovery means for the print head, preliminary auxiliary means, and the like provided as an arrangement of the printer of the present invention since the printing operation can be further stabilized. Examples of such means include, for the print head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated print head or by combining a plurality of print heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Laid-Open Patent Application No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

As described above, according to the present embodiment, in parallel to printing operation where the print head is scanned in a predetermined direction for printing based on print data on a printing medium by a print width, the number of print dots and printing time are measured at each scanning. When printing for one scanning has been completed, starting of the next print-scanning is delayed in accordance with the number of print dots and printing time of the scanning. This reduces electric consumption per unit time and thus minimizing the capacity of the power source.

Accordingly, a small-capacity power source can be employed for driving the printing apparatus. In this case, continuous printing with 100% print-duty ratio is impossible; however, heat generated by the devices constituting the power source does not exceed a rated temperature if the printing with 100% print-duty ratio can be made at least one scanning. Together with this power source, setting waiting time for the next print-scanning at each scanning, in accordance with the print-duty ratio and printing time, attains driving the printing apparatus using the small-capacity power source without varying print speed and the like.

Especially in a printing apparatus which normally prints characters and the like with a low print density and seldom performs printing with a high print-duty ratio, usually waiting time is not set. In this case, the performance of the small-capacity power source is almost equivalent to that of the conventional large-capacity power source corresponding to a maximum load.

Further, counting of the number of print dots and measurement of printing time are made in parallel to one-scanning printing operation, processing time of the CPU and the like are greatly reduced, in comparison with the conventional printing method where print-duty ratio and the like are checked before each print-scanning.

Note that the present embodiment employs a ink-jet printer as an example of printer, however, the present invention is not limited to the ink-jet printer. For example, a thermal-transfer printer which has a print head comprising thermal-energy transducers for generating thermal energy, and which performs printing based on a thermal printing method, can be used.

The present invention is not limited to the above embodiments and various changes and modifications can be made within the spirit and scope of the present invention. Therefore, to apprise the public of the scope of the present invention, the following claims are made.

What is claimed is:

1. A printing apparatus which prints a dot image corresponding to print data on a printing medium by using a print head having a plurality of recording elements, and which has a power source unit supplying electric Power to the apparatus, comprising:

scan means for performing main scanning by relative scanning said print head in a predetermined direction to the printing medium, wherein the predetermined direction is different from a direction in which the plurality of recording elements are arranged;

driving means for driving said print head based on the print data during relative scanning of said print head performed by said scan means; and delay means for delaying a start of relative scanning of said print head by said scan means for a next main scanning, based on a print duty ratio of print data and a scanning period for the current main scanning.

2. The printing apparatus according to claim 1, wherein said power source unit is a rated power source which enables printing with 100% print duty ratio for at least one main scanning.

3. The printing apparatus according to claim 2, wherein said print head is an ink-jet print head which performs printing by discharging ink.

4. The printing apparatus according to claim 3, wherein said ink-jet print head comprises thermal energy transducers for generating thermal energy to be applied to the ink, and for discharging ink by utilizing the thermal energy.

5. The printing apparatus according to claim 2, wherein said print head is a thermal transfer print head which melts an ink film with heat and transfers the ink onto the printing medium.

6. The printing apparatus according to claim 1, wherein said delay means comprises a first counter for counting data transfer clocks used for transferring print data of one main scanning; and a second counter for counting the number of print dots in the print data; and calculating means for calculating the print duty ratio based on the count values of the first and second counters, and the scanning period for main scanning based on the count value of the first counter and the number of the plurality of recording elements.

7. The printing apparatus according to claim 1, wherein said delay means performs the delay of the start of main scanning if the print duty ratio exceeds a predetermined value.

8. The printing apparatus according to claim 7, wherein said delay means calculates delay time by multiplying the print duty ratio, the scanning period and a predetermined coefficient.

9. The printing apparatus according to claim 8, wherein said delay means performs the delay of the start of main scanning based on said delay time.

10. A control method for a printing apparatus for printing a dot image corresponding to print data on a printing medium by performing main scanning by relative scanning of a print head having a plurality of recording elements in a main scanning direction to the printing medium, and wherein the apparatus has a power-source unit supplying electric power to the apparatus, comprising:

a print step of performing main scanning by relative scanning said print head in the main scanning direction and printing the dot image for one main scanning on the printing medium by driving the print head based on the print data during the relative scanning of said print head;

a delay step of delaying a start of relative scanning of said print head at said print step for a next main scanning, based on a print duty ratio of print data and a scanning period for the current main scanning; and a step of performing the next main scanning by starting the relative scanning of said print head after the delay performed at said delay step.

11. The control method according to claim 10, wherein said power source unit is a rated power source which enables printing with 100% print duty ratio for at least one main scanning.

12. The control method according to claim 10, further comprising a step of counting transfer clocks used for transferring print data for one main scanning and a number of print dots of the print data; and a step of calculating the print duty ratio based on the count values of the transfer clocks and the print dots, and the scanning period for main scanning based on the count value of the transfer clocks and the number of the plurality of recording elements.

13. The control method according to claim 10 or 12, wherein said delay step calculates delay time by multiplying the print duty ratio, the scanning period and a predetermined coefficient.

14. A printing apparatus which prints a dot image corresponding to print data on a printing medium by using a print head having a plurality of recording elements, and which has a power source unit supplying electric power to the apparatus, comprising:

scan means for scanning said print head in a main scanning direction which is different from a direction which the plurality of recording elements are arranged;

driving means for driving said print head based on said print data during a scanning performed by said scan means; and delay means for delaying a start of scanning of said print head by said scan means for a next printing, based on information relating to a print-duty ratio and scanning period of said print head corresponding to print data for the current printing.

15. The printing apparatus according to claim 14, wherein said power-source unit which enables printing with 100% print-duty ratio for at least one scanning.

16. The printing apparatus according to claim 14, wherein said print head is an ink-jet print head which performs printing by discharging ink.

17. The printing apparatus according to claim 16, wherein said ink-let print head comprises thermal-energy transducers for generating the thermal energy to be applied to the ink, and for discharging ink by utilizing the thermal energy.

18. The printing apparatus according to claim 14, wherein said print head is a thermal-transfer print head which melts an ink film with heat and transfers the ink onto the printing medium.

19. The printing apparatus according to claim 14, wherein said delay means performs the delay of the start of main scanning if the print duty ratio exceeds a predetermined value.

20. The printing apparatus according to claim 19, wherein said delay means calculates the delay time by multiplying the print duty ratio, the scanning period and a predetermined coefficient.

21. The printing apparatus according to claim 20, wherein said delay means performs the delay of the start of scanning based on said delay time.

22. A control method for a printing apparatus for printing a dot image corresponding to print data on a printing medium by performing main scanning by scanning a print head having a plurality of recording elements in a main scanning direction, and wherein the apparatus has a power source unit supplying electric power to the apparatus comprising:

a print step of printing the dot image for one main scanning by scanning said print head in the main scanning direction;

a delay step of delaying a start of scanning of said print head at said print step for a next main scanning, based on information relating to a print-duty ratio of print data and a scanning period for the current main scanning; and a step of performing the next main scanning by scanning said print head after the delay performed in said delay step.

23. The control method according to claim 22, wherein said power-source unit is a rated power source which enables printing with 100% print-duty ratio for at least one main scanning.

24. The control method according to claim 22, further comprising a step of counting transfer clocks used for transferring print date for one main scanning and a number of print dots in the print data; and a step of calculating the print duty ratio based on the count value of the transfer clocks and the print dots, and the scanning period for main scanning based on the count value of the transfer clocks and the number of the plurality of recording elements.

25. The control method according to claim 24, wherein said delay step calculates a delay time by multiplying the print-duty ratio, the scanning period and a predetermined coefficient.

* * * * *

UNITED STATES PATENT AND TRADEMARK OFFICE

CERTIFICATE OF CORRECTION

PATENT NO. : 6,076,916

DATED : June 20, 2000

INVENTOR(S) : KANEKO

It is certified that error appears in the above-identified patent and that said Letters Patent is hereby corrected as shown below:

COLUMN 2:
Line 49, "groove 5000" should read --groove 5005--.

COLUMN 3:
Line 15, "processing" should read --processings--.

COLUMN 4:
Line 32, "t" should read --at--.
Line 33, "he" should read --the--.

COLUMN 7:
Line 33, "Power" should read --power--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*